United States Patent [19]

Peters

[11] 4,068,620

[45] Jan. 17, 1978

[54] PROFILED ROLLER

[75] Inventor: Wilhelmus G. M. Peters, Venlo, Netherlands

[73] Assignee: Oce-van der Grinten N.V., Venlo, Netherlands

[21] Appl. No.: 647,054

[22] Filed: Jan. 7, 1976

[30] Foreign Application Priority Data

Jan. 13, 1975 Netherlands ..... 7500351

[51] Int. Cl.[2] ..... B05C 1/00; B21B 27/02

[52] U.S. Cl. ..... 118/249; 29/121.2; 29/130; 118/262

[58] Field of Search ..... 118/212, 249, 262; 19/94, 97, 63, 54, 112, 114, 258; 29/130, 121 R, 121 A, 121 H, 124, 110.5; 28/10; 101/5, 6, 213, 328

[56] References Cited

U.S. PATENT DOCUMENTS

| | | | |
|---|---|---|---|
| 5,272 | 8/1847 | Ellsworth | 19/112 |
| 1,414,509 | 5/1922 | Garner | 19/97 |
| 1,493,369 | 5/1924 | Miller | 29/110.5 |
| 2,445,271 | 7/1948 | Heubner | 29/121 A |
| 2,875,724 | 3/1959 | Joa | 118/249 X |
| 3,204,297 | 9/1965 | Wada | 19/114 |
| 3,391,429 | 7/1968 | Watanabe | 19/114 |

FOREIGN PATENT DOCUMENTS

| | | | |
|---|---|---|---|
| 512,690 | 11/1930 | Germany | 19/97 |
| 1,036,725 | 8/1958 | Germany | 19/97 |
| 974,186 | 11/1964 | United Kingdom | 19/114 |
| 22,765 of | 1908 | United Kingdom | 19/112 |

*Primary Examiner*—Dorsey Newton

*Attorney, Agent, or Firm*—Albert C. Johnston; Gerard F. Dunne

[57] ABSTRACT

A profiled roller for pressing sheet material evenly against a roller that applies a film of liquid to the material, without collecting or forming a meniscus of the liquid in the absence of material to be moistened, comprises on a core a sleeve composed of many contiguous identical rings each provided with a peripheral series of protuberances that recur *n* times circumferentially thereof with each ring turned circumferentially relative to a contiguous ring at an angle thereto of less than 360°/*n*. The tops of the protuberances, each having a surface area of less than 0.5 mm², define a cylindrical roller outline and are spaced apart by a distance of 1.5 to 4 mm, providing between them open spaces that will not retain the liquid by capillary action. The opposite sides of each ring are formed with complementary profiles disposed circumferentially apart at the said angle so that the rings may be readily assembled in the required angular disposition on the core.

3 Claims, 6 Drawing Figures

PROFILED ROLLER

The present invention relates to a profiled roller and, more particularly, to a profiled roller for pressing sheet material against a liquid application roller in an apparatus for moistening one side of such material in sheet or web form.

Various devices for moistening one side of sheet or weblike materials are known. Such devices are used, for instance, in photographic copying techniques for developing one side of light sensitive sheet materials, for instance, diazotype materials, by means of a developing liquid. In devices for this use it is important to apply such a thin layer of developing liquid to the light sensitive side of the material that no subsequent heating of the material is required for drying it. Typically, such developing devices comprise an application roller that carries a limited quantity of the developing liquid and means for pressing the sheet material to be developed against the application roller.

In order to effect a uniform application of developing liquid over the entire surface of the sheet material to be developed, which is especially important for obtaining good copy quality when a small amount of developing liquid, usually not more than 4.5 $cm^3/m^2$, is applied to the material, the pressing means must press with a substantially even and constant pressure against the application roller over its entire effective width. Further, the pressing means must be so constructed that, when no sheet material is present, a liquid meniscus will not be formed between the pressing means and the application roller and no or hardly any developing liquid will be received by the pressing means from the application roller.

Dutch patent application No. 73.01622 describes a device for developing one side of light sensitive material, in which the pressing means comprises a plurality of contiguous, identical pressing elements fixed in a rotatably mounted structure so as to swivel about a common support. An elastically deformable member common to the pressing elements is provided between them and the rotatably mounted structure, and, in a direction perpendicular to their tangent with the application roller, the pressing elements are provided with U-shaped incisions to prevent a liquid meniscus from forming when no copying material is being supplied. The elastically deformable member causes the copying material to be pressed against the application roller over its whole effective width with a pressure that is even and constant within very narrow limits. However, when no copying material is being supplied, a quantity of developing liquid is retained in the U-shaped incisions of the pressing elements and is subsequently transferred in a streaky pattern to the leading rear side of a copying material being conveyed through the apparatus. This streaky application of developing liquid is especially annoying when transparent copying materials are used, because with such materials it usually results in a permanent difference of transparency between the parts of the rear side of the copy which have been moistened and those which have not been moistened. This difference often increases further upon aging of the copy, due to variations in yellowing. The latter effect is especially noticeable when transparent one-component diazotype materials are developed with aqueous phloroglucinol developers.

German Pat. No. 561,142 discloses in a developing apparatus a pressing roller which comprises a core having small ringlike pressing elements evenly spaced apart thereon. A similar pressing roller disclosed in U.S. Pat. No. 1,891,722 is composed of freely rotatable pressing rings slid onto a non-rotatable core and separated from each other by spacer rings of smaller diameter than the pressing rings. These known rollers having rings as the pressing elements are not suitable for use in developing apparatus in which only a small quantity of developing liquid is applied to the copying material, because they press the copying material too irregularly against the liquid application roller.

The present invention provides a profiled roller which does not possess the above-mentioned disadvantages, or possesses them to a considerably less extent than the known devices, and which consequently is well suited for use as the pressing roller in developing apparatus in which a small quantity of developing liquid, of not more than 4.5 $cm^3/m^2$, is applied to one side of a copying material.

The profiled roller according to the invention comprises a core and a sleeve thereon composed of a multiplicity of contiguous identical rings, and is characterized in that each ring is provided with a peripheral series of protuberances recurring $n$ times circumferentially of the ring, the tops of which have open spaces therebetween and define a cylindrical roller outline with the tops of the protuberances of the other rings, and in that each ring is turned circumferentially relative to a contiguous ring at an angle thereto which is smaller than $360°/n$.

With this profiled roller a very uniform pressing of copying material against a liquid application roller is achieved. Also, the pressing roller receives only a very small quantity of developing liquid from the application roller, and it will not retain any appreciable quantity of liquid, when no copying material is being supplied. As a result, any application of developing liquid to the rear side of the copying material is restricted to a minimum.

Other features and advantages of the invention will become apparent from the following description, wherein reference is made to the accompanying drawings in which.

Figure 1:
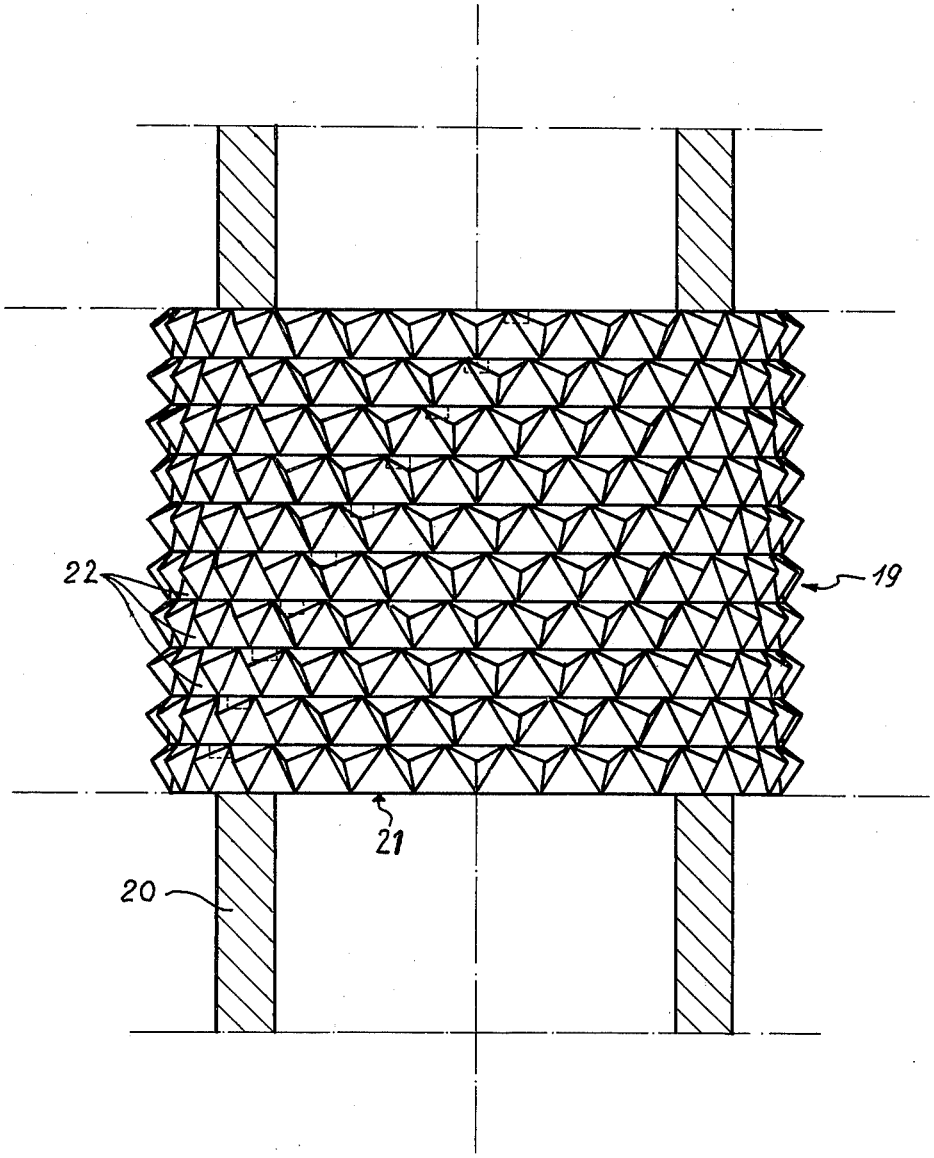
FIG. 1 is a longitudinal vertical cross-sectional view of a portion of a profiled roller according to the invention.
Figure 4:
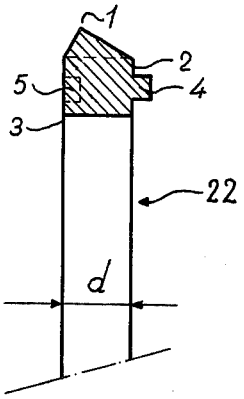
FIG. 4 is a sectional view thereof taken along the line IV—IV of FIG. 2.

As illustrated in FIG. 1, a profiled pressing roller 19 made according to the invention comprises a metal core 20 and a sleeve 21 composed of a plurality of identical profiled rings 22 which are assembled on the core by being slid thereonto and then interengaged side by side with each ring 22 turned to a certain angle circumferentially relative to a contiguous ring so that the respective profiles of contiguous rings are offset one from another. The rings 22 are each profiled peripherally and provided with interengaging profiles on their sides as shown more particularly in FIGS. 2, 3 and 4.

Each ring 22 as shown in FIGS. 2–5 is provided circumferentially with a multiplicity of protuberances 1, between the tops of which there are open spaces at the periphery of the ring. The tops of the protuberances of all the rings 22 define a cylindrical roller outline for engagement against sheet material to be pressed by the roller. The protuberances 1 recur *n* times circumferentially of each ring 22, for instance, about 30 times for a roller having an outside diameter of about 3 cm. In order that a large number of the rings can easily be slipped onto a core and positioned exactly relative to each other, and to prevent the rings from rotating relative to one another, the sides 2 and 3 of each ring are also provided with profiles, such as at least one projection on one side and at least one complementary recess on the other, which profiles can have any desired form provided that at least one profile on one side is complementary to at least one profile on the other side. For instance, the one side 2 may be formed with one or more pins 4, which may be substantially cylindrical as illustrated or, instead, may have the form of a spherical cap, a cone or a truncated cone, and the other side 3 may be formed with an equal number of holes, such as the illustrated cylindrical hole 5, into which the pin or pins 4 of a contiguous ring will fit sufficiently tightly to keep the contiguous rings in a certain angled relationship on the roller core 20.

Figure 2:
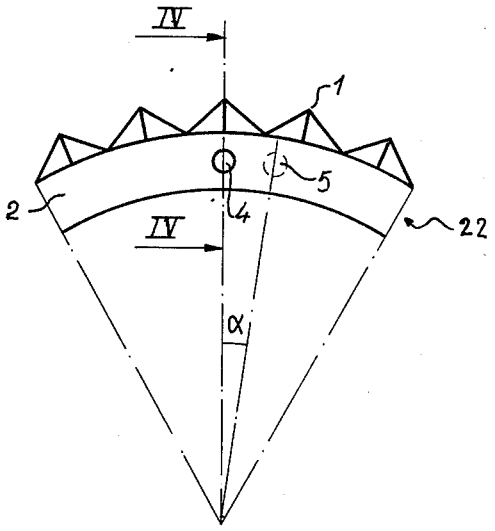
FIG. 2 is a side elevational view of a sector of a profiled ring of the roller.
Figure 3:
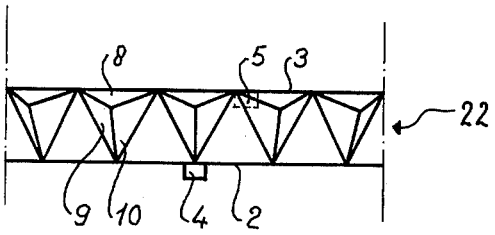
FIG. 3 is a plan view of the ring sector of FIG. 2.

As seen in the plane of FIG. 2 in the drawing, the axis of the hole 5 is located at an angular distance $\alpha$, which is smaller than $360°/n$, away from the axis of pin 4. It results that any two of the rings 22 are turned circumferentially relative to each other by this same angular distance when they are slipped onto the core 20 and interengaged in contiguous relation. Instead of one pin, a plurality of pins can be provided on one side of the ring, and an equal number of holes on the other side. Such pins and holes can be located together in one or more groups or can be evenly spaced apart around the sides of each ring.

Figure 5:
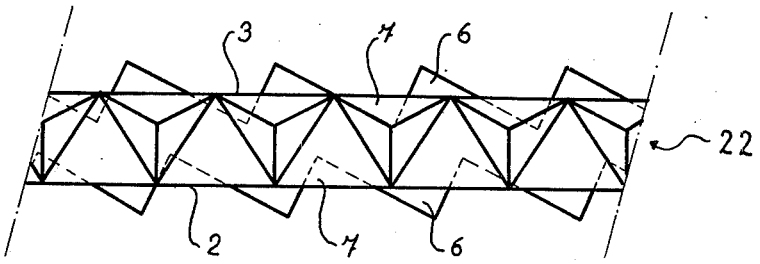
FIG. 5 is a linear projection, in plan view, of a sector of a ring according to a second embodiment of the invention.

The profiles on the sides 2 and 3 of the rings may be formed advantageously in such a way that the rings can be brought exactly into the desired relative position with little or no trouble, for instance, by causing the core on which they are installed to vibrate for a short time. A ring so profiled on its sides is represented in FIG. 5. In this embodiment, both sides of the ring are provided with an identical profile which consists of a circular series of alternate teeth 6 and notches 7. In relation to the profile on the side 3, the profile on the side 2 is again spaced circumferentially away at the required angle $\alpha$, which is smaller than $360°/n$. Another suitable profile by which the rings can be slipped against each other without trouble is obtained by providing one side of each ring with a circumferential series of V-shaped notches and providing the other side with at least one tooth complementary to these notches, which tooth is located circumferentially away from the notches at said required angle.

The protuberances 1, which recur *n* times circumferentially of each ring, may have any desired form provided that the surface area of the top of each protuberance is smaller than 0.5 $mm^2$. Preferably this surface area is smaller than 0.2 $mm^2$. As illustrated in the drawings, each protuberance has a pyramidal shape, being formed for instance as an irregular triangular pyramid having inclined sides 8, 9 and 10. Other suitable forms for the protuberance 1 are, for instance, that of a cylinder, prism, truncated pyramid, cone, truncated cone, obelisk, spherical segment or spherical cap. Preferably each protuberance 1 has a tapering or conical form, because such forms possess a higher mechanical strength than do square-shouldered forms.

The tops of the successive protuberances 1 on the periphery of each ring are spaced apart by a distance of between 1.5 and 4 mm, and preferably of about 3 mm, as measured along the circle described by the tops of the protuberances. The number of protuberances on the periphery of each ring therefore is preferably about equal to the diameter, in mm, of the circle defined by the tops of the protuberances. The thickness *d* of the rings in axial direction preferably is about 2 mm.

The open spaces or recesses between adjacent tops of the protuberances on the sleeve are made sufficiently large to prevent capillary obstruction of liquid transport between the protuberances, i.e., these open spaces do not retain liquid by capillary action but let any liquid received in them flow freely away. The minimum size of the open spaces is also influenced by properties of the liquid that is to be worked up in the apparatus in which the profiled roller is used. When this liquid is an aqueous solution, for instance an aqueous phloroglucinol developer for the diazotype process, generally no capillary obstruction of liquid transport will occur if the section of the open space between the tops of two adjacent protuberances on the sleeve 21 of the roller has an area of at least 1.5 to 2 $mm^2$.

The profiled rings of the roller preferably are composed of synthetic resin or plastic material, but they may also be made of metal. They are manufactured according to known shaping techniques such as extrusion, injection molding or casting.

By slipping the profiled rings, as described above, against each other on a core and subsequently locking the outer rings so that they cannot slide away from each other, a profiled roller is obtained which serves very satisfactorily as the pressing means in a developing apparatus such as that described in Dutch patent application Nos. 73.01622 and 74.08646.

Figure 6:
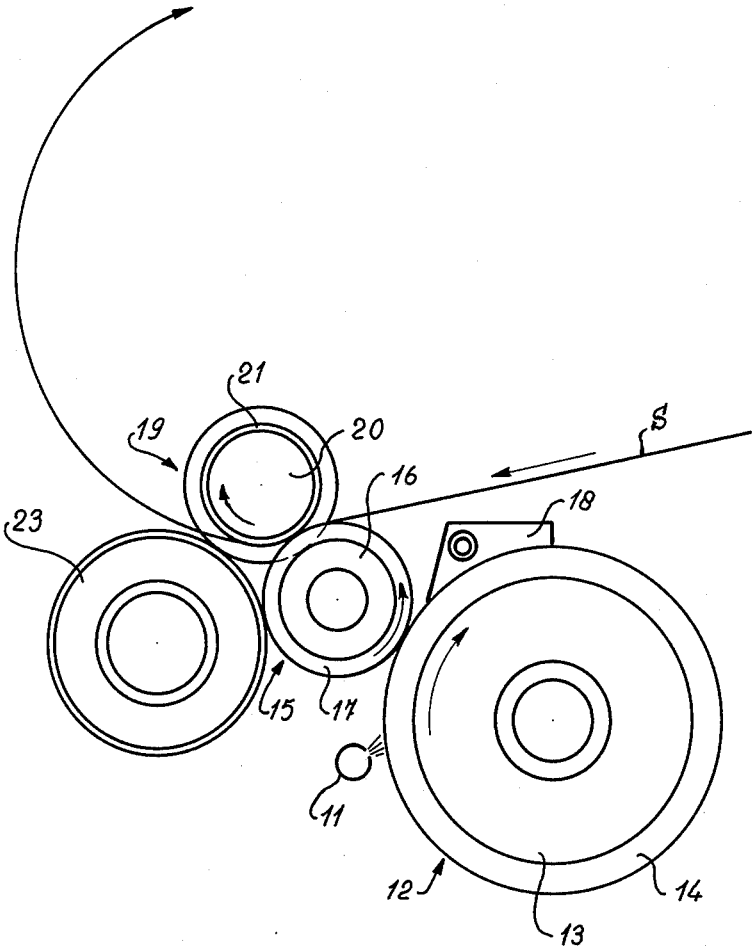
FIG. 6 is a schematic representation of a developing apparatus utilizing a roller according to the invention.

Such a developing apparatus is illustrated in FIG. 6. It comprises a perforated tube 11 through which developing liquid is sprayed onto the surface of a dosing roller 12. The dosing roller comprises a metal core 13 and a plastic sleeve 14 having its outer surface spirally grooved to a depth of about 20 microns. The dosing roller 12 transfers the developing liquid to an application roller 15 which comprises a metal core 16 and a smooth rubber sleeve 17. Superfluous developing liquid at the edges of the dosing roller is drained off via channels (not shown) provided in limiting elements 18 which are installed at either extremity of roller 12, from which the surplus liquid flows to a receiving tray (not shown) situated below dosing roller 12. Pressing against the application roller 15 is the profiled pressing roller 19 which comprises the core 20 having thereon sleeve 21 composed of circumferentially profiled rings 22 as described in detail in relation to FIGS. 2–5. The profile of the rings is not illustrated in FIG. 6.

In the use of such a developing apparatus, a sheet S of diazotype material is fed between the application roller 15 and the profiled pressing roller 19 with the light sensitive side of the sheet turned towards the roller 15, and is guided away from these rollers to a discharge opening (not shown) by a reversing roller 23. As described in Dutch patent application No. 72.07099, the quantity of developing liquid transferred by application roller 15 to the diazotype material depends on the surface structure of the dosing roller 12, the hardness and the hydrophilic character of the application roller 15, the pressure between the dosing roller 12 and the application roller 15 and the pressure between the application roller 15 and the pressing roller 19. In the apparatus illustrated these parameters are adapted to each other so that a developer application of between 1.5 and 4.5 $cm^3/m^2$ is attained.

It will be apparent that a large number of other useful combinations can be provided by use of the present invention.

I claim:

1. A profiled roller comprising a core and a sleeve thereon composed of a multiplicity of contiguous identical rings, characterized in that each said ring is provided with a peripheral series of protuberances recurring *n* times circumferentially of the ring, the tops of which have open spaces therebetween and with the tops of the protuberances of the other rings define a cylindrical roller outline, each said ring being turned circumferentially relative to a contiguous ring at an angle thereto of less than $360°/n$ and each said ring being provided on one of its sides with at least one projection and on its other side with at least one recess each complementary to at least one said projection, each said recess being located circumferentially away from a said projection at an angle relative thereto equal to the aforesaid angle, the tops of said protuberances each having a surface area of less than 0.5 $mm^2$, and the tops of successive protuberances of each ring being spaced apart by a distance of between 1.5 mm and 5 mm, measured along the circle described by said tops, said open spaces each having an area of at least 1.5 $mm^2$ to 2 $mm^2$.

2. In an apparatus for applying a layer of liquid to one side of a sheet material, including a roller for applying the liquid thereto, means for supplying liquid to the peripheral surface of said roller and a roller pressed against said surface for pressing said material thereagainst as the material is fed to and being delivered from between said rollers, the improvement wherein said pressing roller is a profiled roller according to claim 1.

3. Apparatus according to claim 2, said protuberances each being of pyramidal shape.

* * * * *